United States Patent [19]

Ricks

[11] 4,092,793

[45] June 6, 1978

[54] CLIP-ON SIGHT MOUNT

[75] Inventor: Earl C. Ricks, Huntsville, Ala.

[73] Assignee: The United States of America as represented by the Secretary of the Army, Washington, D.C.

[21] Appl. No.: 756,318

[22] Filed: Jan. 3, 1977

[51] Int. Cl.[2] ..... F41G 1/38

[52] U.S. Cl. ..... 42/1 ST; 33/249

[58] Field of Search ..... 42/1 ST, 1 S; 33/250, 33/249, 247, 252; 89/1.816

[56] References Cited

U.S. PATENT DOCUMENTS 2,942,346 6/1960 Staubach ..... 33/250

3,890,879 6/1975 Looger et al. ..... 89/1.816

FOREIGN PATENT DOCUMENTS 1,289,286 2/1962 France ..... 42/1 ST

*Primary Examiner*—Charles T. Jordan

*Attorney, Agent, or Firm*—Nathan Edelberg; Robert P. Gibson; Harold W. Hilton

[57] ABSTRACT

A clip-on sight mount for shoulder fired weapons such as rocket launchers for anti-tank rockets, rifles and other man portable rocket launchers. The sight is quickly attached to the weapon in a manner which will align the sighting axis to the weapon bore with the necessary super elevation.

4 Claims, 8 Drawing Figures

CLIP-ON SIGHT MOUNT

BACKGROUND OF THE INVENTION

Shoulder fired weapons such as man portable rocket launchers have a need for quick reaction sight attachment that will precisely align the weapon bore with the sighting axis.

SUMMARY OF THE INVENTION

A clip-on sight assembly for shoulder fired weapons including a sight mount support secured to the weapon and a sight bracket secured to the sight mount support. The support includes a V-groove along the length of the top thereof and a slot along the length of the bottom surface. A pair of openings are disposed in spaced relation in the mount and open into the slot. A spring is carried in each opening. The sight bracket includes a pair of downwardly depending spaced members having a pair of parallel aligning pins connected therebetween. The pins are in spaced stacked relation. An upper portion of the bracket supports the sight. During assembly of the sight bracket to the support, the upper aligning pin fits in the upper V-groove of the sight mount support and the lower aligning pin fits in the lower slot of the sight mount support.

DESCRIPTION OF THE PREFERRED EMBODIMENT

Figure 1:
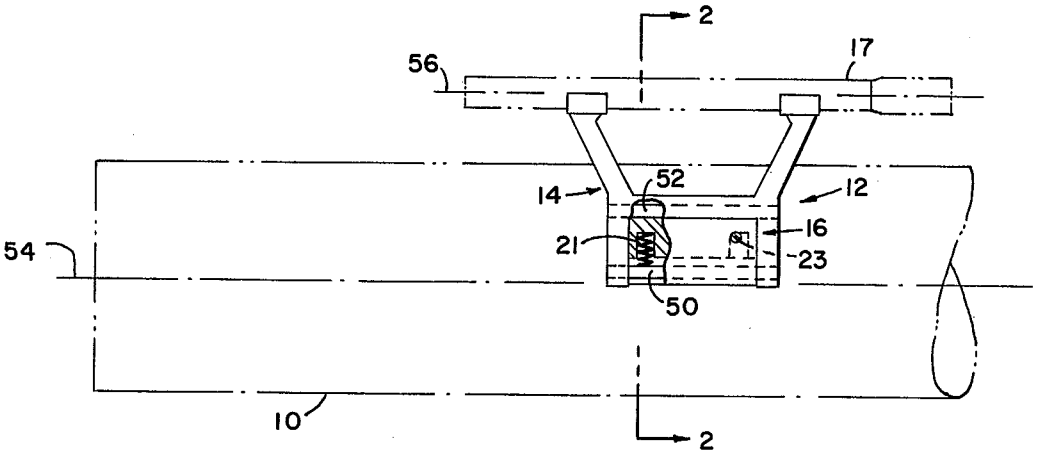
FIG. 1 is an elevational view of a weapon illustrating the clip-on sight of the present invention emplaced thereon.
Figure 2:
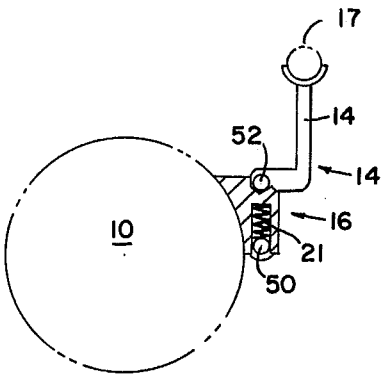
FIG. 2 is a sectional view along line 2—2 of FIG. 1.

As seen in FIG. 1 a shoulder fired weapon 10 such as a rocket launcher or rifle, includes a clip-on sight assembly 12 which includes a sight mount 14 and a sight mount support 16. A sight 17 is carried in mount 14.

Figure 3:
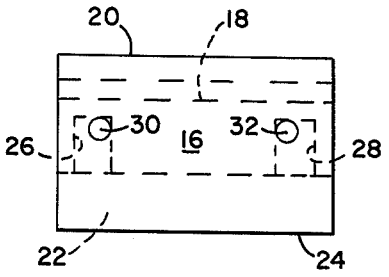
FIG. 3 is a side elevational view of the sight mount support of FIG. 1.
Figure 4:
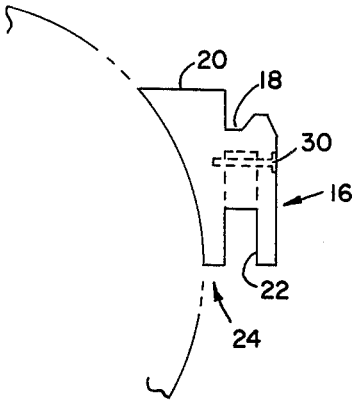
FIG. 4 is an end elevational view of the sight mount support of FIG. 3.

FIGS. 3 and 4 illustrate the sight mount support 16. A V-groove 18 is disposed along the upper surface 20 of the support and a slot 22 is disposed along the lower surface 24 of the support. A pair of spaced openings 26 and 28 are disposed in spaced relation in support 16 and open into the lower slot 22 to receive a pair of springs 21 and 23 (FIG. 1) therein. The springs may be secured in the openings by staking or any well known manner. A pair of openings 30 and 32 are disposed in the mount in spaced relation and transversely to the spaced openings 26 and 28 to receive screws for securing the support to the weapon.

Figure 5:
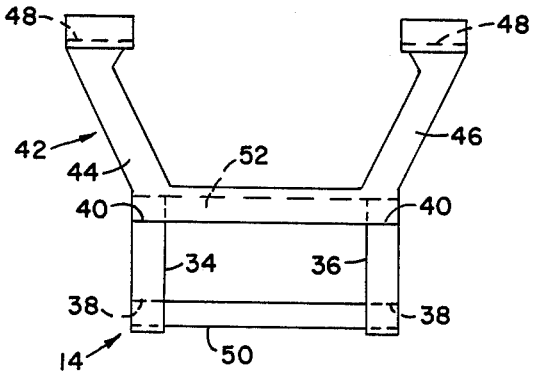
FIG. 5 is a side elevational view of the sight mount bracket of FIG. 1.
Figure 6:
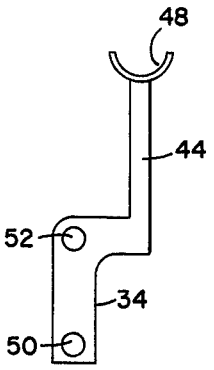
FIG. 6 is an end elevational view of the sight mount bracket of FIG. 5.

As seen in FIGS. 5 and 6 the sight mouunting bracket 14 includes a pair of downwardly depending substantially parallel members 34 and 36 each having spaced parallel openings 38 and 40 therein in stacked relation. An upper portion 42 of the sight mount bracket includes a pair of upstanding arms 44 and 46 being grooved at the upper surface 48 to receive the telescope therein. A pair of pins 50 and 52 are disposed in openings 40 and 38.

To assemble the clip-on mount, lower pin 50 of mounting bracket 14 is positioned in lower slot 22 of mount 16 to compress springs 21 and 23 into openings 26 and 28 and upper pin 52 of bracket 14 is rotated into V-groove 18. In this position springs 21 and 23 biases pin 50 downwardly so that upper pin 52 is snugly engaged in V-groove 18 for alignment of the weapon axis 54 and sight axis 56.

Figure 8:
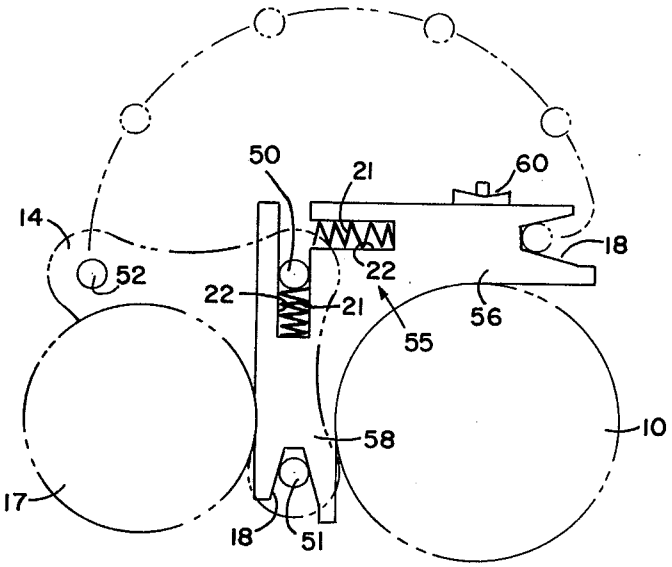
FIG. 8 is a view similar to FIG. 7 with the sight being rotated out of the operator's line of sight.
Figure 7:
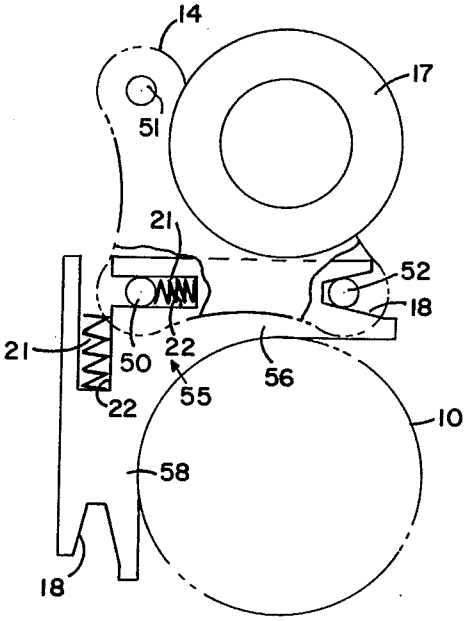
FIG. 7 is an end elevational view illustrating another embodiment of my invention.

FIGS. 7 and 8 illustrate another embodiment of the present invention wherein like numerals refer to like parts. In this embodiment the sight is disposed for rotation out of the user's way so that an open sight on the weapon may be used.

The structure includes a mount 55 which is actually comprised of two portions 56 and 58 which are similar to mounts 16. Each portion includes V-groove 18 and slot 22 and the mount is placed on the weapon with lower slot 22 of each portion 56 and 58 of the mount 55 in adjacent relation. The bracket includes a pair of normally extending portions having telescope 17 mounted thereon. Pin 50 is disposed at the juncture of the normally extending portions. Pin 52 and a third pin 51 is disposed at the distal ends of the normally extending portions.

In this embodiment, portion 56 is across the top of the weapon and portion 58 extends downwardly along the side of the weapon. To use the open sight 60 (FIG. 8), the bracket is moved inwardly to compress springs 21 and 23 and bracket 14 is pivoted so that pin 52 clears the upper surface of the portion 56. The bracket is then positioned in portion 58 with pin 50 in slot 22 and pin 52 in V-groove 18.

I claim:

1. A clip-on sight assembly including a telescope sight, said assembly disposed for removable attachment to a barrel of a weapon comprising:

(a) a bracket for support of said telescope sight thereon, said bracket provided with a pair of normally extending portions having a pair of spaced members provided with first, second and third pins extending therebetween in substantially parallel relation, said first and second pins disposed at the distal ends of said normally extending portions, and said third pin disposed at the juncture of said normally extending portions;

(b) a support member for attachment to said barrel, said support member including a pair of portions in substantially normal relation, said first portion being horizontally disposed across said barrel and said second portion being vertically disposed on said barrel, each said portion having a v-groove along a first surface thereof to receive said first and second pins and a slot along a second surface thereof to receive said third pin, said second surface of each said portion being in adjacent relation; and, (c) biasing means carried in each said portion of said support member for biased engagement with said third pin.

2. A clip-on sight assembly as set forth in claim 1 wherein each said support member includes a pair of spaced openings in normal relation to said slot of each said portion for retention of said biasing means therein.

3. A clip-on sight assembly as set forth in claim 2 wherein said biasing means are springs.

4. A clip-on sight assembly as set forth in claim 3 wherein said V-groove and said slot of said pair of portions are disposed in parallel relation.

* * * * *